US006807527B1

(12) United States Patent
Rozhdestvenskij et al.

(10) Patent No.: US 6,807,527 B1
(45) Date of Patent: Oct. 19, 2004

(54) METHOD AND APPARATUS FOR DETERMINATION OF AN OPTIMUM FIXED CODEBOOK VECTOR

(75) Inventors: Juri Rozhdestvenskij, Moscow (RU); Juri Diachenko, Voskresensk (RU)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/508,183

(22) PCT Filed: Feb. 17, 1998

(86) PCT No.: PCT/RU98/00041

§ 371 (c)(1),
(2), (4) Date: Mar. 7, 2000

(87) PCT Pub. No.: WO99/41737

PCT Pub. Date: Aug. 19, 1999

(51) Int. Cl.[7] ..... G10L 9/14
(52) U.S. Cl. ..... 704/223
(58) Field of Search ..... 704/220–223, 704/219, 216

(56) References Cited

U.S. PATENT DOCUMENTS

| | | | | | |
|---|---|---|---|---|---|
| 5,327,519 | A | * | 7/1994 | Haggvist et al. | 704/219 |
| 5,659,622 | A | * | 8/1997 | Ashley | 381/94.1 |
| 5,899,968 | A | * | 5/1999 | Navarro et al. | 704/220 |

FOREIGN PATENT DOCUMENTS

| | | | | |
|---|---|---|---|---|
| EP | 0 149 724 | * | 7/1985 | 704/223 |
| EP | 0 331 857 | | 9/1989 | G10L/9/14 |
| EP | 0 501 420 | | 9/1992 | G10L/9/16 |
| WO | WO95/06310 | | 3/1995 | G10L/9/14 |

OTHER PUBLICATIONS

Bastiaan Kleijn, Daniel Krasinski, Richard H. Ketchum: "Fast Methods for the CELP Speech Coding Algorithm", IEEE Transactions on Acoustics, Speech and Signal Processing; vol. 38; No. 8; Aug. 1990; pp. 1330–1342.

Sharad Singhal, Bishnu S. ATAL: "Improving Performance of Multi–Pulse LPC Coders at Low Bit Rates"; Proc. Int. Conf. Acoust., Speech, Signal Process: (San Diego), 1984, pp. 1.31–1.3.4.

Claude R. Galand, Jean E. Menez, Michele M. Rosso: "Adaptive Code Excited Predictive Coding", IEEE Transactions on Signal Processing, vol. 40, No. 6, Jun. 1992, pp. 1317–1326.

IS–127 Standard "Enhanced Variable Rate Codec, Speech Service Option 3 for Wideband Spread Spectrum Digital System", Apr. 19, 1996, Sec. 4.5.7, PN–3292 (to be published as IS–127), Official Ballot Version.

* cited by examiner

*Primary Examiner*—Richemond Dorvil
*Assistant Examiner*—Donald L. Storm
(74) *Attorney, Agent, or Firm*—James L. Clingan, Jr.; Jonathan R. Retsky

(57) ABSTRACT

A method for a CELP algorithm including the steps of pre-processing (101) a sampled speech s{n} in a signal pre-processor so as to output at least a noise filtered speech output vector and a channel noise estimate, model parameter estimation of the noise filtered speech output vector so as to output a prediction residual and a long term prediction gain, encoding the prediction residual so as to output an adaptive codebook vector including an index of impulse response functions of a filter and a vector gain, formatting the encoded speech packets, is proposed wherein the step of encoding comprises in the following order the steps of determination of the gain by choosing a start value close to a theoretical optimal value, and vector optimisation by successive searching for an extremum of an estimate function based on a recursively corrected correlation vector.

Further, a digital signal processor for processing electrical signals to determine a codebook vector and a gain of said codebook vector is provided that operates correspondingly to the method according to the invention.

9 Claims, 3 Drawing Sheets

METHOD AND APPARATUS FOR DETERMINATION OF AN OPTIMUM FIXED CODEBOOK VECTOR

FIELD OF THE INVENTION

The invention relates to a method and an apparatus for a speech coding algorithm, in particular for a code excited linear predictive (CELP) coding algorithm. CELP algorithms are utilised in two-way voice communications, e.g. between a base station and a mobile station in a cellular system. A method for a CELP algorithm includes the steps of pre-processing a sampled speech s{n} in a signal preprocessor so as to output at least a noise filtered speech output vector and a channel noise estimate, model parameter estimation of the noise filtered speech output vector so as to output a prediction residual and a long term prediction gain, encoding the prediction residual so as to output an adaptive codebook vector including an index of impulse response functions of a filter and a vector gain, and formatting the encoded speech packets.

The CELP algorithm was found to provide good speech quality at intermediate bit rates, that is 4800 or 9600 bps. However, the vector quantization of the excitation signal requires an extremely high computational effort. Several suggestions have been made for speeding up the vector quantization including the use of overlapping codebook vectors.

BACKGROUND OF THE INVENTION

Code excited linear predictive (CELP) algorithms are described by S. Sinhal and B. S. Atal: "Improving performance of multi-pulse LPC coders at low bit rates" in Proc. Int. Conf. Acoust., Speech, Signal Process. (San Diego), 1984, pp. 1.3.1–1.3.4 and by W. B. Kleijn, D. J. Krasinski, and R. H. Ketchum: "Fast methods for the CELP speech coding algorithm" in IEEE Trans. Acoust., Speech, Signal Process., Vol.38, No. 8, pp. 1330–1342, 1990. CELP coding algorithms are utilised for processing sampled speech on a subframe by subframe basis. The spectral envelope of the speech signal is described by a filter of which the coefficients are obtained using the linear prediction technique. The coefficients are quantized so that the filter can be constructed on both the transmitter and the receiver side. The filter coefficients are determined by an analysis-by-synthesis procedure. A set of such candidate excitation sequences or vectors is stored in a codebook. The index of the vector producing the most accurate speech is transmitted to the receive end of the channel. The input speech on the transmitter side is regained on the receiver side by synthetic speech that is generated using the vector of which the index has been transmitted.

The main task is to find an optimum vector in the codebook which describes most accurately the input speech. Fast vector quantization and excellent synthetic speech quality makes the CELP algorithms attractive for speech coding applications. The implementation of the CELP algorithm in a spread spectrum digital system is described in the IS-127 Standard "Enhanced Variable Rate Codec, Speech Service Option 3 for Wideband Spread Spectrum Digital Systems", Apr. 19, 1996, Section 4.5.7, "Computation of the algebraic CELP Fixed Codebook Contribution". The codebook utilised in this standard is a fixed codebook with an algebraic codebook (ACELP) structure.

In order to find the optimum codevector in the algebraic codebook the ACELP codebook is searched by minimising the mean-squared error (MSE) between the weighted input speech and the weighted synthesis speech. In other words, the codebook is searched by maximising the term $$T_k = \frac{C_k^2}{E_k},$$

where $C_k$ is the correlation of the impulse response and the perceptual domain target signal and $E_k$ is the energy or covariance of the impulse response of the codebook vector, both at position k. The codebook vector is a series of unit pulses, each pulse being at an appropriate position in the codebook and having an appropriately chosen sign.

In order to determine the optimum algebraic codebook vector the correlation and energy terms should be computed for all possible combinations of pulse positions and signs. This, however, is a prohibitive task. In order to simplify the search, two strategies for searching the pulse signs and positions as explained below are used.

The pulse signs are pre-set (outside the closed loop search) by considering the sign of an appropriate reference signal. Amplitudes are pre-set by setting the amplitude of a pulse at a position equal to the sign of the reference signal at that position. With this "new" components a modified correlation $C_k'$ and a modified energy $E_k'$ is calculated.

Having pre-set the pulse amplitudes as explained above the optimum pulse positions are determined using an efficient non-exhaustive analysis-by-synthesis search technique. In this technique the term $T_k$ is tested for a small percentage of position combinations using an iterative "depth-first" tree search strategy.

Once the positions and signs of the excitation pulses are determined, the "new" codebook vector is built as a series of unit pulses, each pulse being at a "new" position in the codebook.

The gain of the fixed codebook vector is determined afterwards by:

$$g_c = \frac{C_k}{E_k}.$$

This fixed codebook search algorithm as proposed in the IS-127 Standard has the following disadvantages:

The term $$T_k = \frac{C_k^2}{E_k}$$

is a non-linear multidimensional multi-extremum function. The task of searching for an extremum of this non-linear multidimensional multi-extremum function is solved in a combinatorial way that can result in finding a local extremum rather than a global one, when the available computational performance is limited.

The computation of the minimising function is very time consuming and necessitates a large number of computation cycles. Namely, the fixed codebook search method as proposed in the IS-127 Standard assumes a linear search for pulse positions in each track and requires 1144 calculations. Moreover, the evaluation of $T_k$ includes a division operation that augments considerably the complexity of the algorithm.

Thus, there is a need for a method and an apparatus for a CELP algorithm which is faster than the prior art implementations and which is less expensive in terms of computational cycles, which however maintains the maximum achievable accuracy.

SUMMARY OF THE INVENTION

The underlying problem of the invention is solved basically by applying the feature laid down in the independent claims. Preferred embodiments are given in the dependent claims.

The need for improved efficiency of a fast multi-pulse coding algorithm for speech residuals on frames with a constant length is met by the present invention. The method and apparatus according to the present invention, provide for a fast convergence of the algorithm such that the optimum vector may be searched for more efficiently than with the prior art.

The basic idea underlying the invention is the decomposition of the task of finding an optimum codebook vector into two sub-tasks:

calculation of the amplitude gains for the coding pulses (first stage);

computation of the optimum sample positions for the coding pulses (second stage).

It should be noted that the calculation sequence according to the present invention is reverse to the one that is described in the prior art according to the IS-127 Standard.

The method according to the invention permits to reduce the multidimensional multi-extremum non-linear task of searching for optimum coding pulse positions of a discrete source signal to an optimum extremum search task with a multidimensional square form that is minimised sequentially for every pulse. This decreases essentially the computation time and provides a higher coding accuracy.

At the first stage the optimum codevector gain "$g_c$" is determined according to the equation:

$$g_c = a\sqrt{\frac{\sum_{i=1}^{N}[x(i)]^2}{\sum_{i=1}^{N} i\cdot[h(N-i+1)]^2}},$$

where x is a source discrete signal (perceptual domain target signal vector), h is a special function (impulse response of the filter), a is an experimentally determined weighting coefficient, and N is a subframe length.

An optimum value for the weighting coefficient "a" is experimentally determined for an appropriate function "h" and a given number "n" of non-zero code-vector components. For n=8 and an impulse response of a weighting synthesis filter "$h_{wq}$" the value a=2 has been obtained.

In the second stage the sequential search for optimum positions of the coding pulses is performed. The n codevector components at the positions p(j) $\epsilon\{1, \ldots, N\}$, j=1 . . . n, are sequentially searched for by maximising an estimate function, F(p(j)), which determines the contribution of the j-th pulse to a speech signal residual:

$$F(p(j)) = \max_{p(j)}\{2|d_j(p(j))| - g_c\varphi(p(j), p(j))\},$$

for p(j)=1, . . . , N and j=1, . . . , n, where $$\varphi(1, m) = \sum_{k=\max\{l,m\}}^{N} h(k-l)\cdot h(k-m),$$

which is the covariance array of all impulse response functions h of the filter. Here $$d_{j+1}(i)=d_j(i)-\mathrm{sign}(d_j(p(j))\, g_c\Phi(i, p(j)),$$

where $$d_1 = \sum_{k=i}^{N} x(k)\cdot h(k-i)$$

is the original cross-correlation vector of the impulse response function and the source discrete signal for j=1.

BEST MODE FOR CARRYING OUT THE INVENTION

Figure 1A:
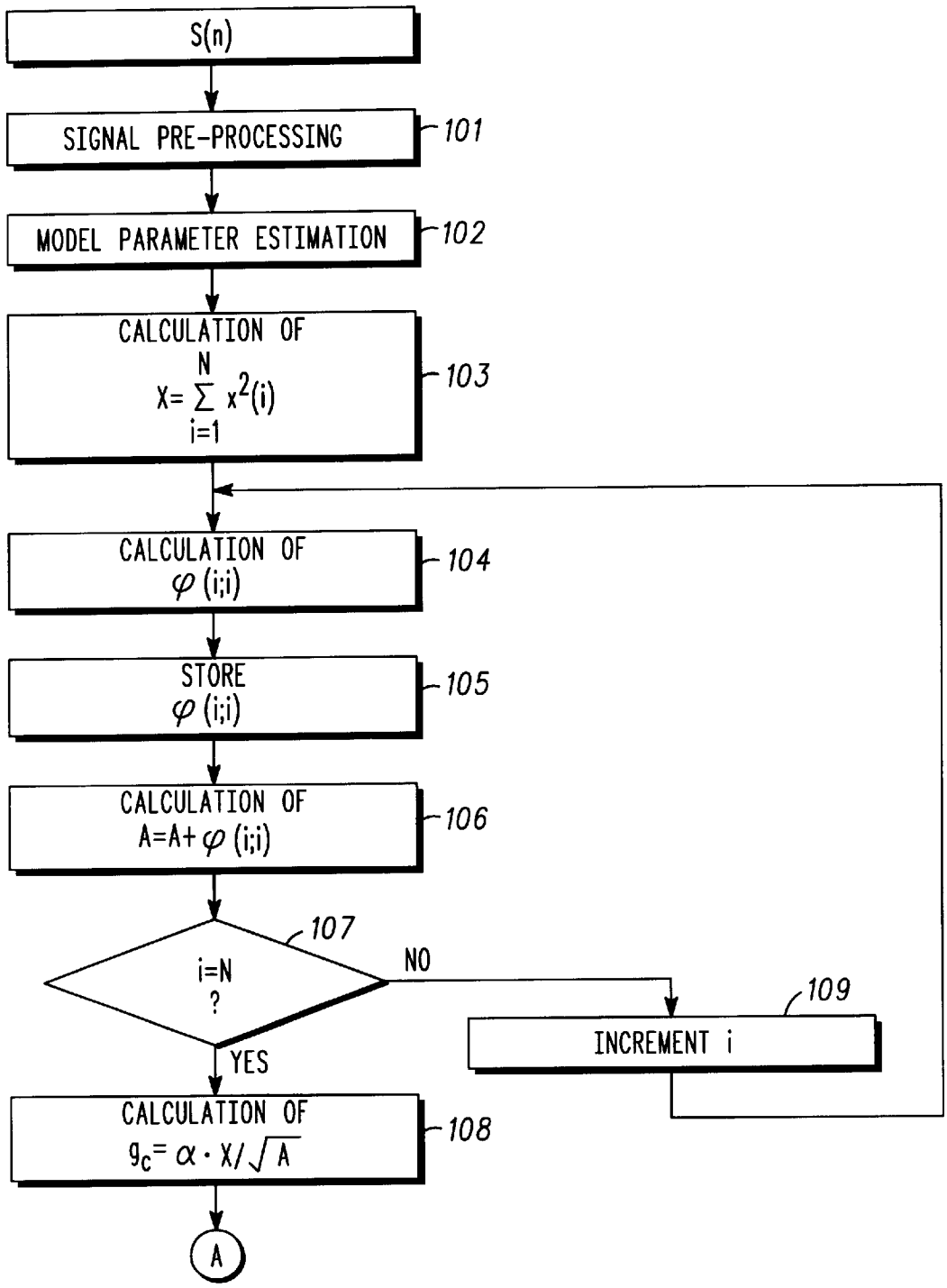
FIGS. 1*a* and 1*b* are flow charts of a particular implementation of the invention incorporating a particular application of an approximation strategy for the gain evaluation.

For the detailed description of embodiments according to the invention reference is made to the designations in IS-127 Standard (edit version 6, TR-45): MSE is a mean square error of deviation of the fixed codebook search target vector, $x_w$, from the fixed codebook contribution in a subframe; SNR is the signal-to-noise ratio, in dB, with the modified (shifted) original speech signal, $s_w$, used as a processed signal and the difference between it and the reconstructed signal, with the aid of adaptive and fixed codebooks, considered as a noise; mean SNR is an SNR averaged on a speech fragment and computed as a mean SNR value for all frames transmitted at a rate of 9600 bps and at a rate of 4800 bps, named Rate 1 and Rate ½, respectively. All p(j) are distributed over 5 tracks T0 . . . T4. Three of the tracks are allocated 2 of the 8 non-zero pulses each, two of the tracks are allocated 1 of the 8 pulses each. The two tracks with 1 pulse each are cyclically adjacent to each other, i.e. track 3 and track 4 may contain 1 pulse each, track 4 and track 0 may contain 1 pulse each and so on.

The general task as it is determined by the fixed codebook structure according to the IS-127 Standard is formulated for Rate 1 as follows: A vector p(j), j=1 . . . 8, and a gain $g_c$ is to be found which satisfies the equation $$F(g_c; \vec{p}) = \min\sum_{i=1}^{N}\left[x_w(i) - g_c\sum_{j=1}^{8} h_{wq}(i-p(j))\right]^2$$

under the restrictions as defined by a fixed codebook structure as well as by the following conditions:

$$g_c>0,$$

$$0\leqq p(j)\leqq 54,\ j=1 \ldots 8,$$

$$p(j)\neq p(k),\ j,k=1 \ldots 8,$$

$$h_{wq}(j-p(j))=0,\ j-p(j)<0.$$

where N is a subframe size.

This is a typical task of an extremum search for a multidimensional function with a complex boundary of the area of permissible solutions. The function being minimised is a non-linear 9-order function having in general more than one extremum. The restrictions form a non-linear boundary of the area of permissible solutions so that the number of local extrema is additionally increased and the search for a global extremum becomes even more complicated. The search for a real minimum of the MSE of the encoding of a discrete signal obtained by subtracting the adaptive codebook output from the modified (shifted with respect to the RCELP-algorithm) original residual may thus be unsuccessful.

The first step in the method according to the invention is the calculation of the gain.

In a first embodiment of the invention the gain is taken to be $$g_c \sim X,$$

where $$X^2 = \sum_{i=1}^{N} x_w^2(i)$$

is the energy of the source discrete signal. In other words, the optimal value of $g_c$ is taken to be proportional to the mean-squared amplitude of signal $x_w$ in a subframe. The energy of the source discrete signal is compared to the trace of the covariance matrix of the impulse response functions of the filter. In other words, the summation of all diagonal covariance terms is carried out so as to yield a gain $g_c$:

$$g_c = \alpha \cdot \frac{X}{\sqrt{\sum_{i=1}^{N} \varphi(i;\, i)}}.$$

This gain calculation is shown in FIG. 1*a*. After preprocessing of the signal s{n} in step 101 and estimation of model parameters in step 102 the energy X of the preprocessed speech signal is calculated in step 103. In the loop 104 through 109 the diagonal elements of the covariance matrix are determined. At step 104 a first diagonal element $\phi((i,i)$ is calculated, namely $\phi(\mathbf{1,1})$. It is stored in a memory for later purposes, step 105. Further, at step 106 the value $\phi((i,i)$ is added to a value A so as to yield eventually the trace of the covariance matrix:

$$A = A + \phi(i, i)$$

This iteration is repeated until i=N. In other words, the process branches back to step 104 in order to calculate the next $\phi(i,i)$ as long as i<N and exits the loop at step 107 when i=N and the calculation of the trace is completed.

With the value of X from step 103 and the value of A from step 106 the gain of the codevector is calculated according to $$g_c = \alpha \cdot \frac{X}{\sqrt{\sum_{i=1}^{N} \varphi(i;\, i)}} = \alpha \cdot \frac{X}{\sqrt{A}},$$

where $\alpha$ is a coefficient which is to be adapted to the speech residual and A is a mere and temporary substitute for the trace of the covariance matrix of the subframe under consideration.

A particular advantage of the above embodiment is its comparatively low computational effort. Although the covariance terms $\phi(i,i)$ have to be computed for all pulse positions in a subframe (N=53 or 54 in the IS-127 standard) this does not augment the overall computational effort since the diagonal terms are available for further computations which will be described below.

Other implementations which may be faster than the above embodiment, however on the expense of accuracy of the gain computation, have been devised and implemented in further embodiments (not shown) of the invention by the inventors.

It was found by the inventors that satisfying results can already be achieved by an approximation that a particular simple modification of the first implementation of the method according to the invention can be realised for determination of $g_c$: the first embodiment relies—save for the discrete source signal and the subframe length—exclusively on the covariance of the first diagonal term in the covariance matrix, i.e. on $\phi(\mathbf{1,1})$. This first term of the covariance matrix is "expanded" by multiplication with N, the subframe length, and is then compared to the mean squared source signal X. The gain can thus be written:

$$g_c = \alpha \cdot \frac{X}{\sqrt{N \cdot \varphi(1;\, 1)}}$$

with $\alpha$ being a proportional coefficient. With this implementation the calculation of diagonal elements is reduced to only one. The advantage of this embodiment is that the calculation of all the other covariance terms in the subframe is obsolete.

In a further one of these embodiments (not shown) of the invention the gain is expressed by the simple equation:

$$g_c = \alpha \cdot \sqrt{\frac{X^2}{N}},$$

where $\alpha$ is a constant coefficient and N is the subframe length. However, this approach is only admissible for $X^2 \gg F_{min}(g_c;\, \vec{p}_{opt})$. But this precondition holds in most of the sampled speech residuals. An analysis of the gain as evaluated by this approach shows that a high accuracy of the approximation is achievable.

In another implementation (not shown) of the invention it is assumed that the first pulse contains up to 70% of information. Thus the first pulse is a main candidate for the $g_c$ calculation. Since, however, the value of $g_c$ exceeds the optimal value, if it is determined on the first pulse only, more pulses are taken into account. The according relation of this gain calculation implementation is given by:

$$g_c = a \cdot g_{c1} + \sum_{i=2}^{k} g_{ci},$$

where: $g_{ci}$ is the gain $g_c$ for i-th pulse, k is the number of pulses for the $g_c$ determination, a is the weighting coefficient of the first pulse.

The influence of the first pulse on the SNR has experimentally been investigated with different speech signals and numbers of pulses. It was found by the inventors that a number of k=8 pulses would give the best results. The MSE could be reduced to 30%.

In order to improve the accuracy of the determination of the gain $g_c$ over the last embodiment, the influence of the covariance of the impulse response functions is taken into account. The corresponding implmentation relies on the weighted first pulse and the mean-squared amplitude $X^2$ of the signal in a subframe:

$$g_c = a \cdot g_{c1} + b \cdot \sqrt{X^2/N},$$

where a, b are weighting coefficients and $g_{c1}$ is the first pulse amplitude. The advantage of this embodiment is its low computational complexity with a high degree of accuracy of the gain since the consideration of the covariance of the impulse response functions leads to different optimised sets of coefficients a and b for diverse speech fragments.

A comparative analysis of these algorithms shows excellent results for all the above algorithms. However, the first algorithm necessitates the largest computational effort. In general, the above algorithms, that take the changes of the impulse response function covariance into account, require additional computational effort. However, this is compensated by the fact that a part of the calculated terms is needed for the vector search anyway, that will be explained below. So the computational effort is only shifted from the vector search to the gain computation and would not increase dramatically due to the fact that a part of the results of the gain computation is also available for the vector search.

Having completed the evaluation of the gain the method proceeds at "A" in FIG. 1*a* with finding the optimum vector {p(j), j=1, . . . , 8}, where 8 is the maximum number of vector components in the IS-127 system.

This search is performed in a particular embodiment of the method by a sequential variant of the multi-pulse coding method for the excitation residual. Under consideration of the diagonal terms in the covariance matrix only the function which is to be minimised can be written in the form:

$$F(g_c;\, p(j)) = \min_{p(j)}\left[\sum_{i=1}^{N} x_w^2(i) - \frac{d_j^2(p(j))}{\varphi[p(j);\, p(j)]}\right], \quad j = 1 \ldots 8,$$

where $$d_j(p(j)) = \sum_{k=p(j)}^{N} w_x(k) \cdot h(k - p(j))$$

is the correlation for the pulse position p(j), and $$\varphi((p(j);\, p(j)) = \sum_{k=p(j)}^{N} h(k - p(j)) \cdot h(k - p(j))$$

is the covariance for the pulse position p(j).

The sign of the pulse p(j) is defined by the equation:

$$\mathrm{Sign}(p(j)) = \mathrm{Sign}(d_j(p(j)))$$

In a next step the cross-correlation vector, $d_j$, is corrected on the basis of p(j−1), which was determined previously:

$$d_j[i] = d_j[i] - g_c \cdot \mathrm{Sign}(p(j-1)) \cdot \phi[i;\, p(j-1)],\ i = 1 \ldots N,$$

where $g_c$ is the gain that was determined in the gain calculation sequence above. By sequentially repeating the calculation procedure of the last three equations the pulse position p(j) is optimised before proceeding with the pulse position p(j+1).

Figure 1B:
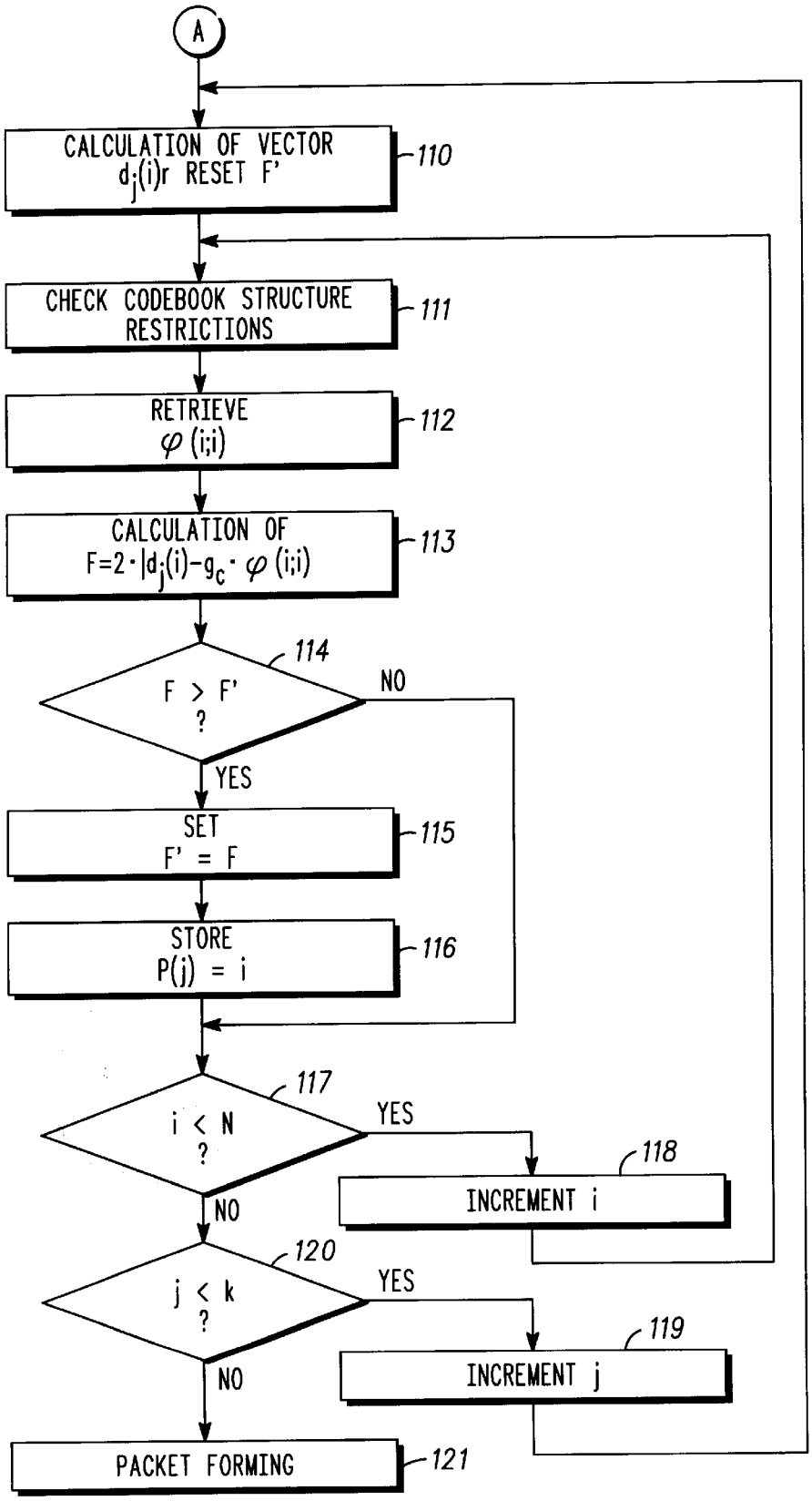

The implementation of this procedure is shown in FIG. 1*b*. The above task $$F(g_c;\, p(j)) = \min_{p(j)}\left[\sum_{i=1}^{N} x_w^2(i) - \frac{d_j^2(p(j))}{\varphi[p(j);\, p(j)]}\right], \quad j = 1 \ldots 8,$$

is equivalent to finding the maximum of the function $$F(p(j)) = \max_{p(j)}\{2|d_j(p(j))| - g_c\varphi(p(j),\, p(j))\},$$

for p(j)ϵ{1, . . . , N} and j=1, . . . , k, where k 32 8 in the IS-127 standard.

At the first step of the vector finding procedure the correlation of speech residual and impulse response function $d_j(i)$ is calculated (step 110) and a variable F' for temporarily storing the currently best value of the maximised criterion F is reset. Although not explicitly mentioned in FIG. 1*b* also non-diagonal terms ϕ(i,j) are determined at step 110 which are required for correlation vector correction for j=2, . . . , 8. At the next step 111 the fixed codebook structure restrictions are checked, and if they are violated the procedure branchs to step 117. At the step 112 the covariance terms ϕ(i,i) are retrieved from the memory which were calculated in the course of the gain-computation above.

With the values of the gain $g_c$, the correlation vector $d_j(i)$ and the covariance vector ϕ(i,i) an estimate function F is calculated in step 113. The value of F is compared to a value F', which was determined previously. In case the last evaluated value of F is greater than the previous F' the new value is stored in a memory at step 115, the value of p(j)=i is stored in a memory at step 116 and the procedure proceeds at step 117. At step 117 it is checked whether or not all sample positions in a subframe are estimated. If not the procedure proceeds after the query in step 117 at step 111 with an incremented i (step 118). If all sample positions have been estimated the search procedure checks at step 120 whether or not the evaluation of all vector components is completed. If so the procedure of finding the optimum codevector is finished for the subframe under consideration and at step 121 the packet is formatted for the transmission to the receiver side of the channel. If the evaluation of the vector components is not yet completed the procedure proceeds after the query in step 120 at step 110 with an incremented j (step 119).

The method according to the invention has several advantages over the prior art: The vector 1/ϕ(i,i) needs only be calculated once per subframe. Hereby the computational effort of the search procedure for an optimum vector is significantly reduced. The number of non-diagonal elements in a covariance array ϕ(i,j) to be calculated is reduced to seven rows (out of 54) of the covariance array; it is not necessary to calculate all non-diagonal rows of the covariance array (54) as with the prior art. The number of cycles of the criterion calculation is restricted to the number of pulses multiplied by the subframe length (e.g. 8*54=432), whereas the number of necessary cycles with the prior art (IS-127 Standard) is 1144 (for a combinatorial successive search which necessitates four iterations through the fixed codebook structure). But, in fact, the search according to the method of the present invention can be truncated after a number of cycles that is essentially less. The fixed codebook structure restrictions for the pulses are checked only after four pulses have been found. The sign of pulses is determined automatically avoiding thus additional filtering of the speech residual signal $x_w$ and computation of a reference vector on each subframe. By correcting the largest MSE deviations consecutively, the method according to the invention converges very fast. Thus, both global and local extrema are found at the boundary which are close to the global one.

The inventors found an increase of the mean SNR value of up to 0.7 dB with the method according to the invention for the most part of test speech fragments. Further, the computational complexity was found to be smaller by factor 2–3 than with the prior art algorithm implementations. This was attributed to the successive search of the code vector components with the recursive calculation (correction) of the vector $d_j(i)$, i=1 . . . N, before searching for each component.

The real gain corresponding to the code vector found can be computed (as in IS-127) instead of using the calculated $g_c$. This slightly improves the synthesised speech quality, but requires some additional computational efforts.

Figure 2:
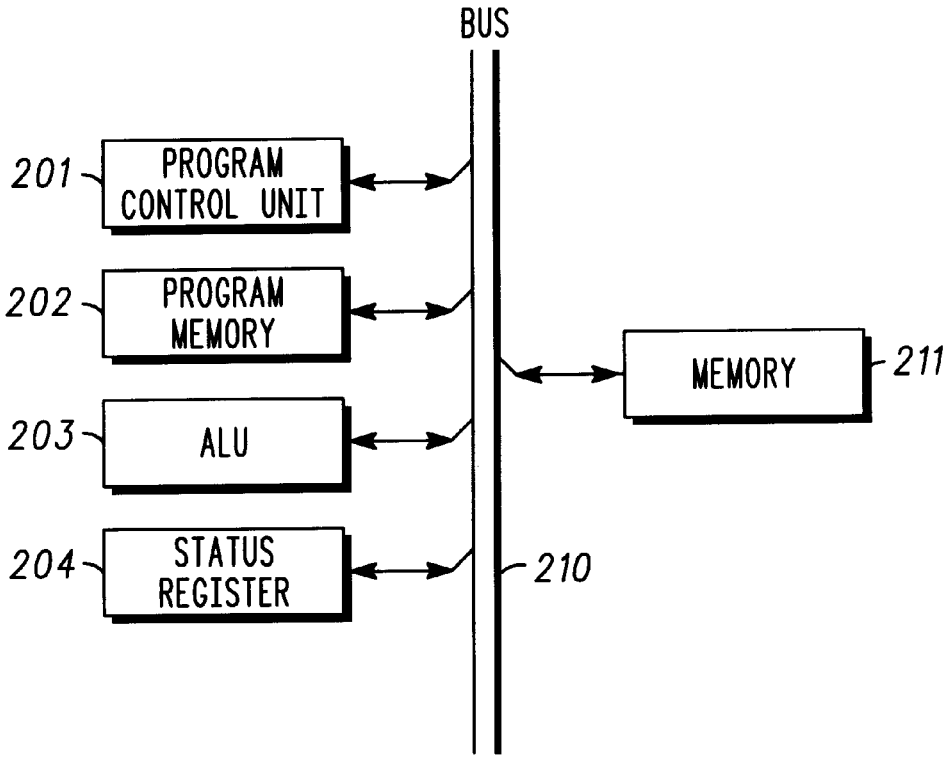
FIG. 2 shows a block diagram of a computer hardware implementation of the invention.

FIG. 2 illustrates a hardware implementation of the present invention. A computer program for the implementation of the present invention may be stored in a program memory 202 which is preferably a ROM. Other memory 211 (RAM) is necessary for temporarily storing the values of correlation terms ($d_j(i)$), covariance terms ($\phi(p(i,i)$ and $\phi(p(i);p(j))$ ), source discrete signal energy (X) and gain ($g_c$). In the ALU 203 the calculations of the various formulas above are performed where the status register 204 indicates the status of the ALU 203 to other components. All components of the hardware implementation are coupled through a data bus 210. The result of the search for the optimum vector is also output via the data bus 210.

In this description the rate was not considered because it does not affect the computations of gain and optimum codebook vector according to the invention. However, it is obvious to those skilled in the art that the rate is determined in accordance with the noise on the channel and with the signal energy estimate.

What is claimed is:

1. A method for a CELP algorithm including the steps of:

pre-processing a sampled speech s{n} in a signal pre-processor so as to output at least a noise filtered speech output vector and a channel noise estimate, model parameter estimation of the noise filtered speech output vector so as to output a prediction residual and a long term prediction gain, encoding the prediction residual so as to output an adaptive codebook vector including an index of impulse response functions of a filter and a fixed codebook vector gain, formatting encoded speech packets, wherein the step of encoding comprises in the following order the steps of:

determination of the fixed codebook vector gain by choosing a start value close to a theoretical optimal value, and vector optimisation by successive searching for an extremum of an estimate function based on a recursively corrected correlation vector.

2. A method according to claim 1, wherein the fixed codebook vector gain is determined on the basis of the energy of the sampled speech frame and the trace of the covariance matrix of a set of impulse response functions.

3. A method according to claim 2, wherein the optimum vector is determined by adapting a correlation term of the sampled speech signal and the impulse response function to a previously found vector component and reinserting the adapted correlation term into the estimate function.

4. A method according to claim 1, wherein the fixed codebook vector gain is determined on the basis of the energy of the sampled speech frame and the covariance term of a first impulse response function.

5. A method according to claim 4, wherein the optimum vector is determined by adapting a correlation term of the sampled speech signal and the impulse response function to a previously found vector component and reinserting the adapted correlation term into the estimate function.

6. A method according to claim 1, wherein the fixed codebook vector gain is determined on the basis of the energy of the sampled speech frame and the frame length.

7. A method according to claim 6, wherein the optimum vector is determined by adapting a correlation term of the sampled speech signal and the impulse response function to a previously found vector component and reinserting the adapted correlation term into the estimate function.

8. A digital signal processor for processing electrical signals to determine a codebook vector and a gain of said codebook vector comprising:

means for pre-processing a sampled speech s{n} in a signal pre-processor so as to output at least a noise filtered speech output vector and a channel noise estimate, means for model parameter estimation of the noise filtered speech output vector so as to output a prediction residual and a long term prediction gain, means for encoding the residual so as to output an adaptive codebook vector including an index of impulse response functions of a filter and a fixed codebook vector gain, means for formatting encoded speech packets, wherein encoding is performed in the following order by:

means for determination of the fixed codebook vector gain by choosing a start value close to a theoretical value, and means for vector optimisation by successive searching for an extremum of an estimate function based on a recursively corrected correlation vector.

9. An electronic apparatus comprising a digital signal processor for processing electrical signals to determine a codebook vector and a gain of said codebook vector, the digital signal processor comprising:

means for pre-processing a sampled speech s{n} in a signal pre-processor so as to output at least a noise filtered speech output vector and a channel noise estimate, means for model parameter estimation of the noise filtered speech output vector so as to output a prediction residual and a long term prediction gain, means for encoding the residual so as to output an adaptive codebook vector including an index of impulse response functions of a filter and a fixed codebook vector gain, means for formatting encoded speech packets, wherein encoding is performed in the following order by:

means for determination of the fixed codebook vector gain by choosing a start value close to a theoretical value, and means for vector optimisation by successive searching for an extremum of an estimate function based on a recursively corrected correlation vector.

* * * * *